US008808118B2

(12) United States Patent
Yang

(10) Patent No.: US 8,808,118 B2
(45) Date of Patent: Aug. 19, 2014

(54) BASKETBALL HOOP

(75) Inventor: Chui-Ching Yang, New Taipei (TW)

(73) Assignee: Jiao Hsiung Industry Corp., Shulin Dist., New Taipei (TW)

( * ) Notice: Subject to any disclaimer, the term of this patent is extended or adjusted under 35 U.S.C. 154(b) by 252 days.

(21) Appl. No.: 13/334,821

(22) Filed: Dec. 22, 2011

(65) Prior Publication Data

US 2013/0165276 A1 Jun. 27, 2013

(51) Int. Cl.
*A63B 63/08* (2006.01)

(52) U.S. Cl.
CPC ..... *A63B 63/08* (2013.01)
USPC ..... 473/486

(58) Field of Classification Search
USPC ..... 473/485, 486, 488; D8/323; 16/222
See application file for complete search history.

(56) References Cited

U.S. PATENT DOCUMENTS

| | | | | | |
|---|---|---|---|---|---|
| 5,932 | A * | 11/1848 | Acker | 408/147 |
| 308,537 | A * | 11/1884 | Walsh | 16/305 |
| 391,433 | A * | 10/1888 | Stover | 16/300 |
| 622,383 | A * | 4/1899 | O'Brien | 4/241 |
| 1,417,084 | A * | 5/1922 | Maier | 16/305 |
| 4,534,556 | A * | 8/1985 | Estlund et al. | 473/486 |
| 5,255,910 | A * | 10/1993 | Simonseth | 473/481 |
| 6,296,583 | B1 * | 10/2001 | Tatar, Sr. | 473/486 |
| 6,503,160 | B2 * | 1/2003 | Hehr | 473/486 |
| 2006/0148598 | A1 * | 7/2006 | Mahoney | 473/481 |
| 2013/0165276 | A1 * | 6/2013 | Yang | 473/486 |

* cited by examiner

*Primary Examiner* — Gene Kim
*Assistant Examiner* — M Chambers
(74) *Attorney, Agent, or Firm* — Charles E. Baxley

(57) ABSTRACT

A basketball hoop has a stationary panel, a first pivoting seat, a rim assembly, a second pivoting seat and a torsion assembly. The torsion assembly has at least one torsion spring and a pivoting rod. The pivoting rod is mounted through the first pivoting seat and the second pivoting seat to pivotally mount the stationary panel around the rim assembly. The torsion springs offer a resilient force to resist the force of bending the rim assembly. With the torsion springs mounted around the pivoting rod, the basketball hoop in accordance with the present invention reduces the amount of the components. With the decrease of the amount of the components, the installation is easier and faster, and the cost is reduced therefore.

4 Claims, 6 Drawing Sheets

BASKETBALL HOOP

BACKGROUND OF THE INVENTION

1. Field of the Invention

The present invention relates to hoop, especially to a basketball hoop that reduces the amount of components and lowers the cost.

2. Description of the Prior Arts

For long, basketball is one of the most popular sports. Playing basketball needs a basket hanged on a high place to be shot by the ball from players.

With reference to FIGS. 5 and 6, a conventional basket comprises a backboard 60 and a hoop 61. The hoop 61 is mounted on the backboard 60 and comprises a stationary panel 70, a rim 80, a pivoting rod 90 and a resilient assembly 100.

The stationary panel 70 is mounted on the backboard 60 and has a first pivoting seat 71 and a resilient panel 72. The first pivoting seat 71 has two axial holes 711. The resilient panel 72 has a through hole 73.

The rim 80 has a pivoting panel 81 formed transversely on an edge of the rim 80. The pivoting panel 81 is parallel to the resilient panel 72 of the stationary panel 70 and has a through hole 83 and a second pivoting seat 82. The through hole 83 aligns with the through hole 73 of the resilient panel 72. The second pivoting seat 82 has two axial holes 821 aligning with the axial holes 711 of the first pivoting seat 71 of the stationary panel 70.

The pivoting rod 90 is mounted through the axial holes 711 of the first pivoting seat 71 and the axial holes 821 of the second pivoting seat 82 to pivotally mount the rim 80 around the stationary panel 70.

The resilient assembly 100 has a spring 101 and a fastening rod 102. The spring 101 is mounted between the pivoting panel 81 of the rim 80 and the resilient panel 72 of the stationary panel 70. The fastening rod 102 is mounted through the through hole 83 of the pivoting panel 81, the spring 101, and the through hole 73 of the resilient panel 72 to fasten the spring 101.

The rim 80 is connected pivotally to the stationary panel 70 so as to provide the rim 80 with a resilient force to absorb the force from the ball shocking the rim 80 or slam dunk. The resilient force also prevents the angle between the backboard 60 and the rim 80 from changing after long time of using.

However, the hoop 61 needs a pivoting rod 90 to pivotally mount those elements, and also needs a resilient assembly 100 to provide a resilient force. Therefore, the whole structure and the installation of the hoop 61 are complicated, and the cost is increased.

To overcome the shortcomings, the present invention provides a basketball hoop to mitigate or obviate the aforementioned problems.

SUMMARY OF THE INVENTION

The main objective of the present invention is to provide a basketball hoop that reduces the amount of components and lowers the cost.

The basketball hoop in accordance with the present invention has a stationary panel, a first pivoting seat, a rim assembly, a second pivoting seat and a torsion assembly. The torsion assembly has at least one torsion spring and a pivoting rod. The pivoting rod is mounted through the first pivoting seat and the second pivoting seat to pivotally mount the stationary panel around the rim assembly. The torsion springs offer a resilient force to resist the force of bending the rim assembly.

With the torsion springs mounted around the pivoting rod, the basketball hoop in accordance with the present invention reduces the amount of the components. Compared to the conventional hoop, the torsion assembly combines the effects of pivotally mounting elements and offering a resilient force, and the basketball hoop omits a resilient panel and a fastening rod therefore. With the decrease of the amount of the components, the installation is easier and faster, and the cost is reduced therefore.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
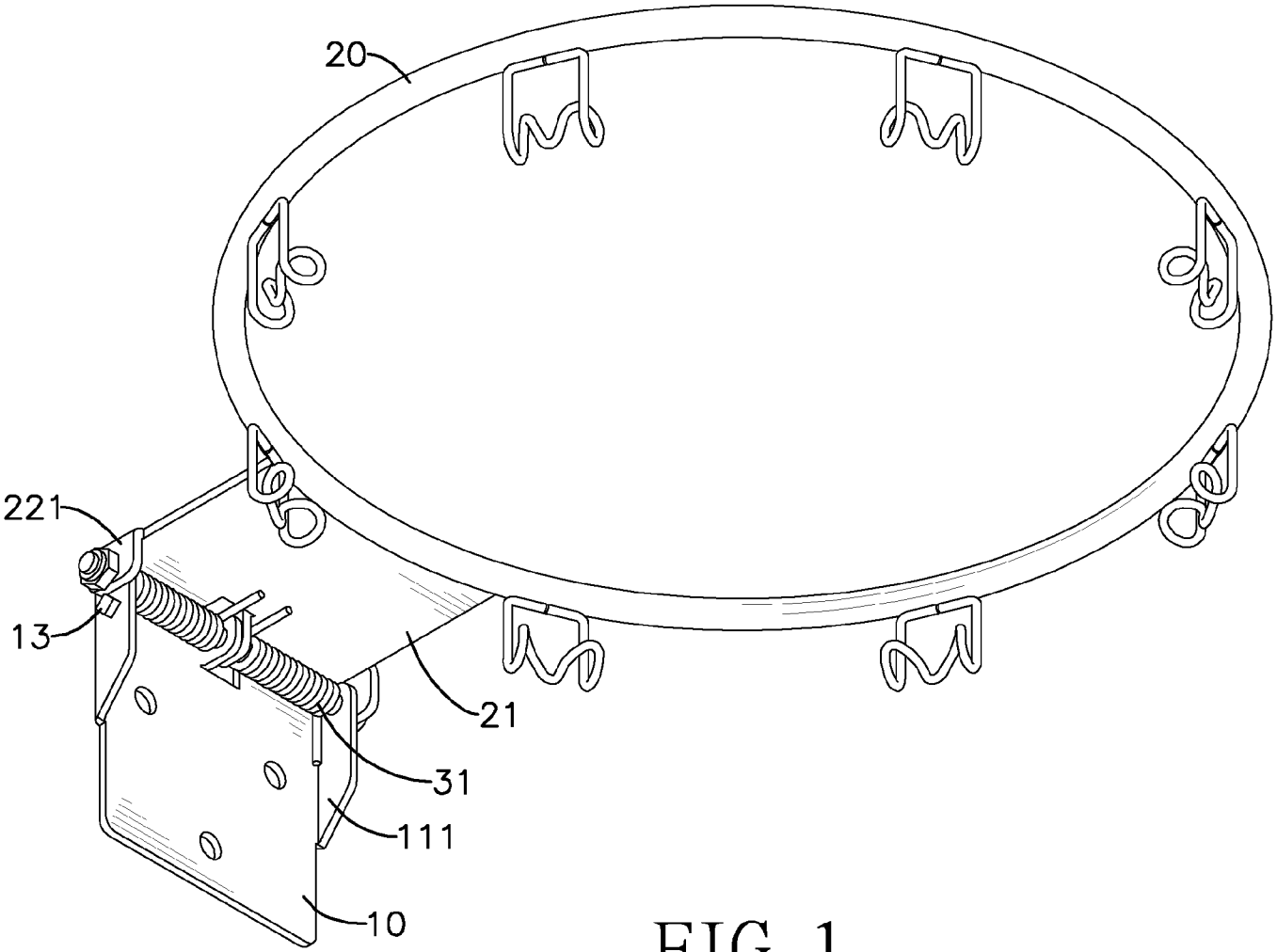
FIG. 1 is a perspective view of a basketball hoop in accordance with the present invention.
Figure 2:
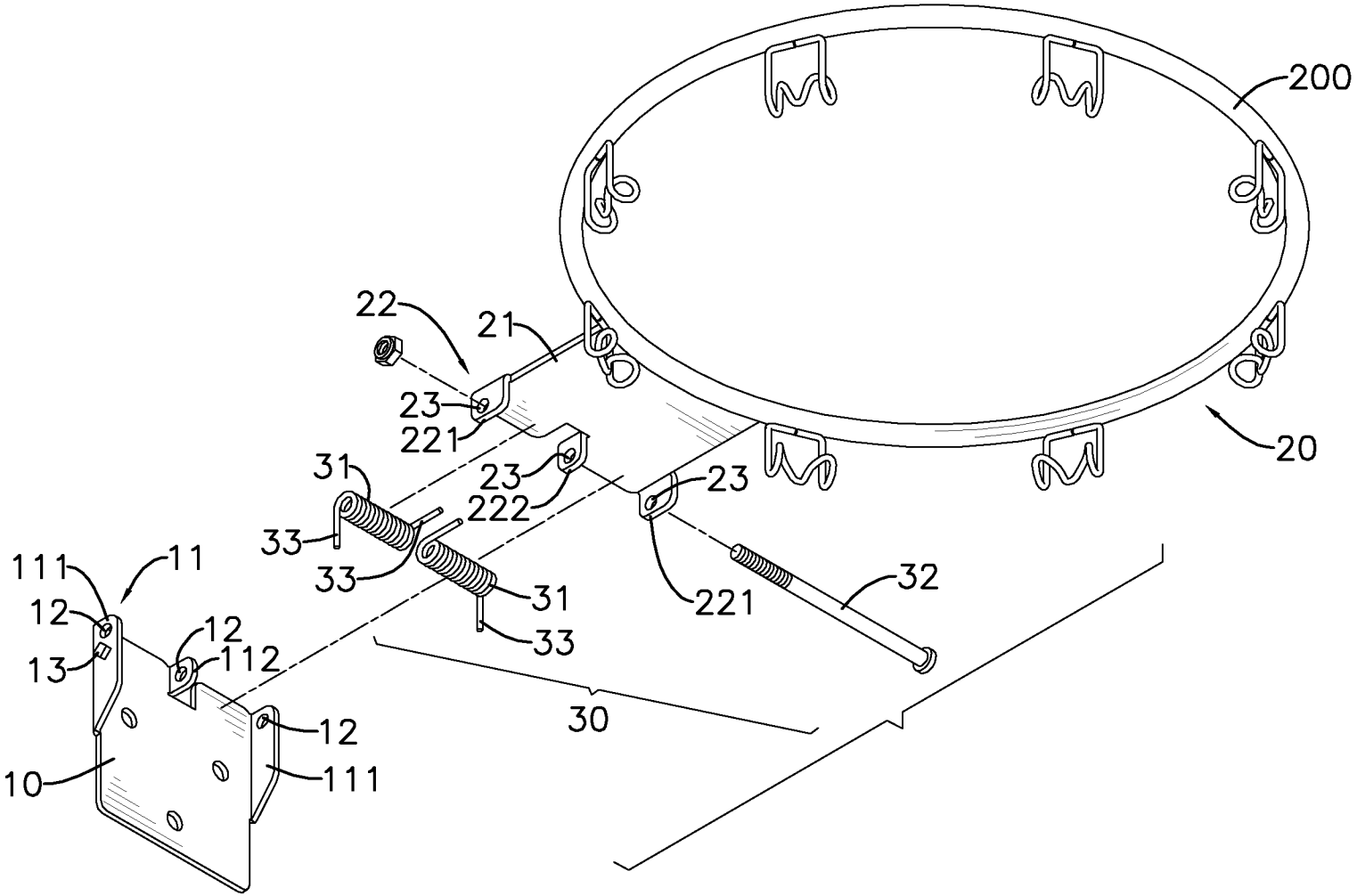
FIG. 2 is an exploded perspective view of the basketball hoop in FIG. 1.

With reference to FIGS. 1 and 2, a basketball hoop in accordance with the present invention comprises a stationary panel 10, a first pivoting seat 11, a rim assembly 20, a second pivoting seat 22 and a torsion assembly 30.

Figure 3:
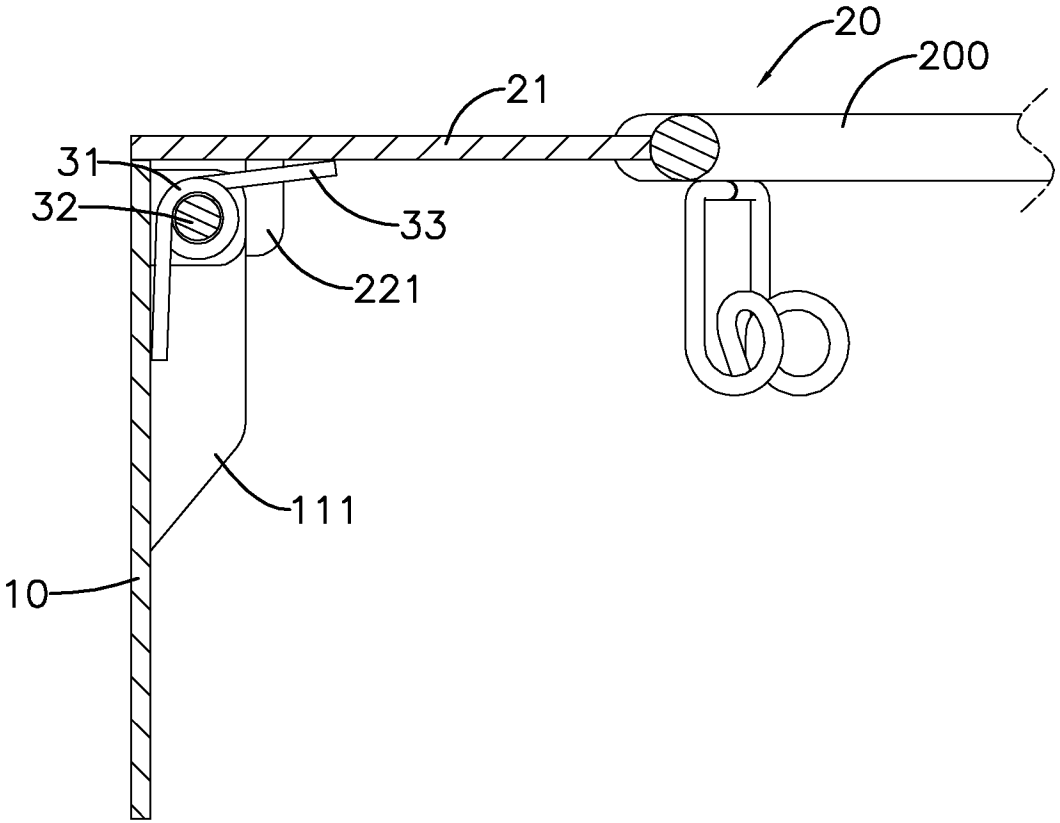
FIG. 3 is an enlarged side view in partial section of the basketball hoop in FIG. 1.

With reference to FIGS. 1 to 3, the first pivoting seat 11 is formed on the stationary panel 10 and has at least one axial hole 12. The at least one axial hole 12 is formed through the pivoting seat 11. In a preferred embodiment, the first pivoting seat 11 has two outer tabs 111, a central tab 112, three axial holes 12 and two stops 13. The outer tabs 111 are formed respectively on two opposite sides of the stationary panel 10. The central tab 112 is formed on the stationary panel 10 and is formed between the outer tabs 111. The axial holes 12 are formed respectively through the outer tabs 111 and the central tab 112. Each stop 13 is formed on a corresponding outer tab 111.

The rim assembly 20 is connected pivotally to the stationary panel 10 and has a rim body 200 and a pivoting panel 21. The rim body 200 is connected pivotally to the stationary panel 10. The pivoting panel 21 is formed on and extends out from an annular edge of the rim body 200, and is connected pivotally to the stationary panel 10. In a preferred embodiment, the pivoting panel 21 transversely extends out from the rim body 200.

The second pivoting seat 22 is formed on the pivoting panel 21 of the rim assembly 20, is connected pivotally to the first pivoting seat 11 to mount the rim assembly 20 pivotally to the stationary panel 10, and has at least one axial hole 23. The at least one axial hole 23 is formed through the second pivoting seat 22 and aligns with the at least one axial hole 12 of the first pivoting seat 11. In a preferred embodiment, the second pivoting seat 22 has two outer tabs 221, a central tab 222 and three axial holes 23. The outer tabs 221 of the second pivoting seat 22 are formed respectively on two opposite sides of the pivoting panel 21. Each outer tab 221 of the second pivoting seat 22 selectively abuts a corresponding stop 13 of the outer tabs 111 of the first pivoting seat 11. The central tab 222 of the second pivoting seat 22 is formed on the pivoting panel 21 and is formed between the outer tabs 221 of the second pivoting seat 22. The axial holes 23 of the second pivoting seat 22 are formed respectively through the outer tabs 221 and the central tab 222 of the second pivoting seat 22.

The torsion assembly 30 is connected between the first pivoting seat 11 and the second pivoting seat 22, and has at least one torsion spring 31 and a pivoting rod 32. The at least one torsion spring 31 is mounted between the first pivoting seat 11 and the second pivoting seat 22, and each one of the at least one torsion spring 31 has two ends 33 respectively and directly abutting the stationary panel 10 and the pivoting panel 21. The pivoting rod 32 is mounted through the at least one axial hole 12 of the first pivoting seat 11, the at least one axial hole 23 of the second pivoting seat 22, and the at least one torsion spring 31. In a preferred embodiment, the torsion assembly 30 has two torsion springs 31. The torsion springs 31 are respectively mounted between the central tab 112 and the outer tabs 111 of the first pivoting seat 11, and are respectively mounted between the central tab 222 and the outer tabs 221 of the second pivoting seat 22. The ends 33 of the torsion springs 31 that abut the pivoting panel 21 are mounted adjacent to each other.

Figure 4:
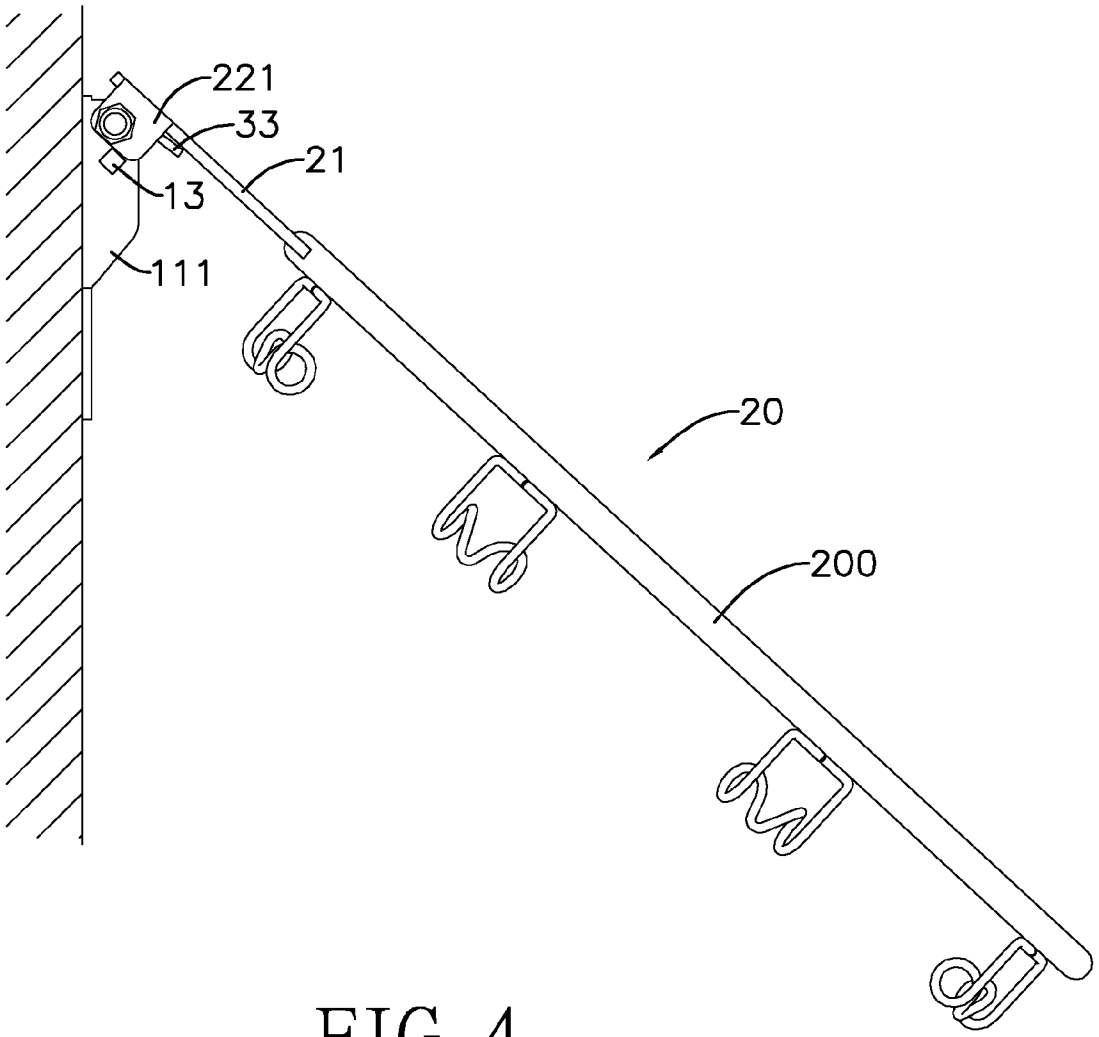
FIG. 4 is an operational side view of the basketball hoop in FIG. 1, showing the rim folded.
Figure 5:
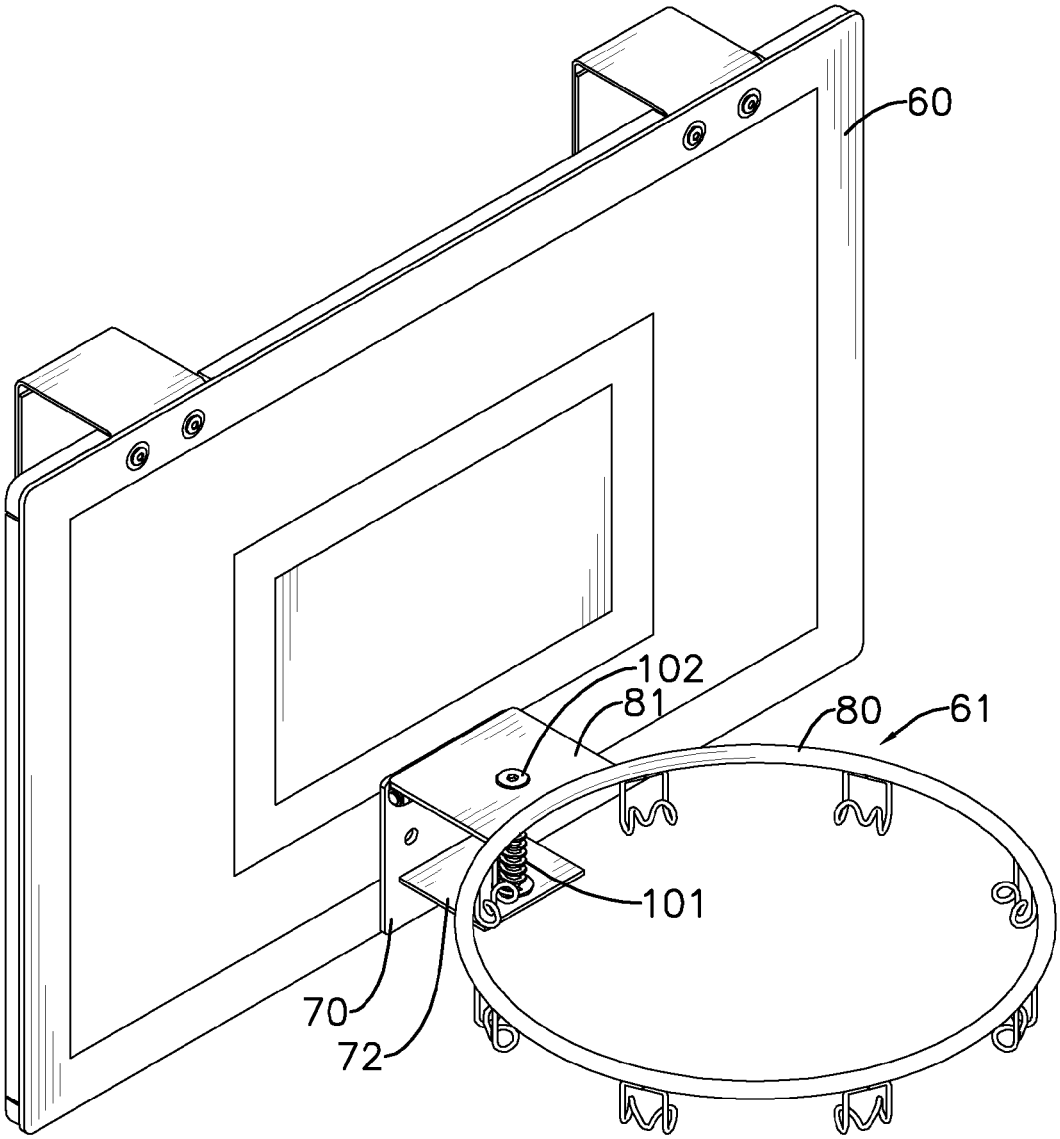
FIG. 5 PRIOR ART
FIG. 5 is a perspective view of a conventional basket in accordance with the prior art.
Figure 6:
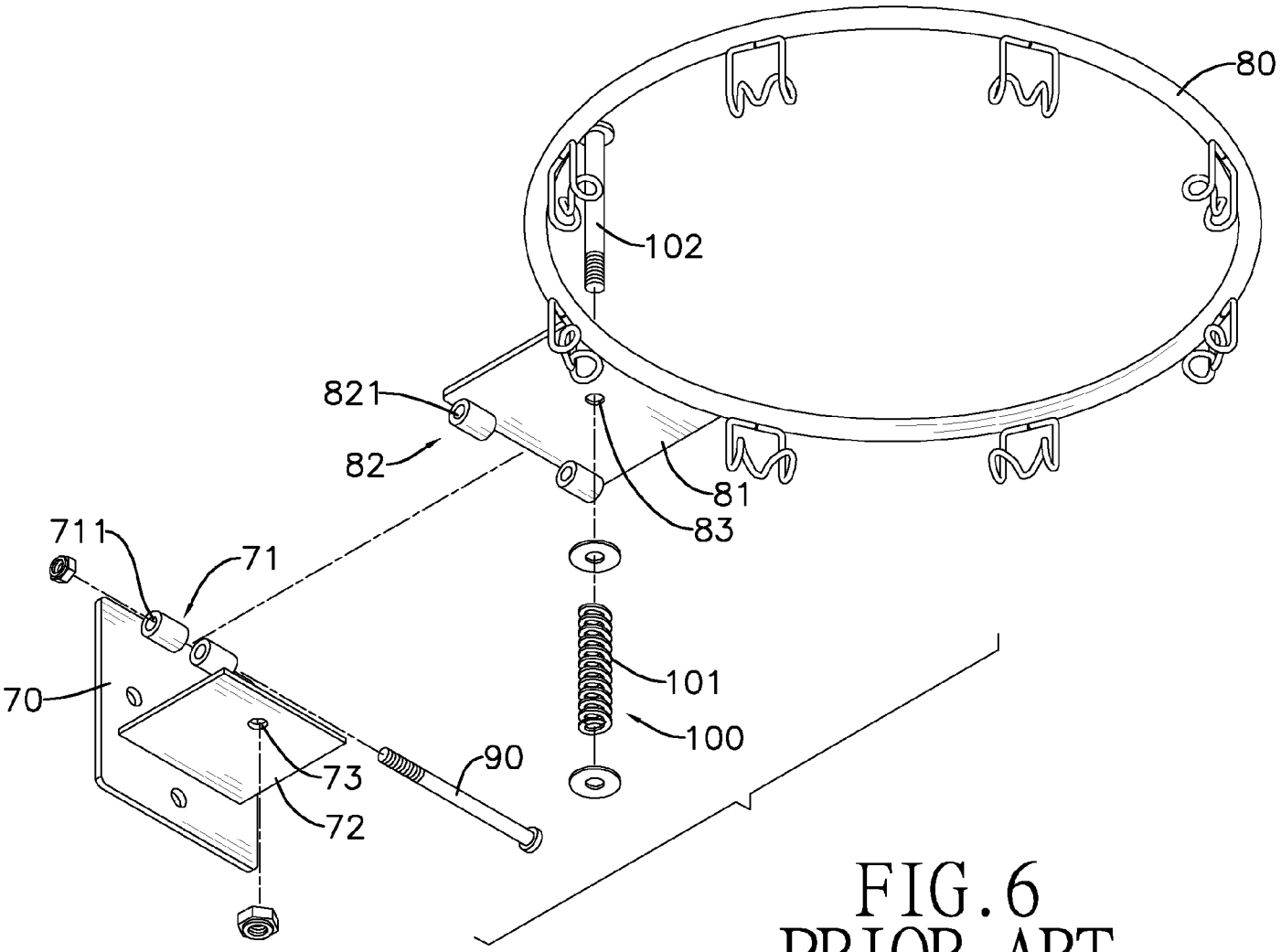
FIG. 6 PRIOR ART
FIG. 6 is a partially exploded perspective view of the conventional basket in FIG. 5.

With reference to FIGS. 2 to 4, the pivoting rod 32 of the torsion assembly 30 is mounted through the two pivoting seats 11, 22 to pivotally mount the stationary panel 10 around the rim assembly 20. The torsion springs 31 of the torsion assembly 30 offer a resilient force to resist the force of bending the rim assembly 20. With the torsion springs 31 mounted around the pivoting rod 32, the basketball hoop in accordance with the present invention reduces the amount of the components. With the decrease of the amount of the components, the installation is easier and faster. The installation of the basketball hoop comprises only two acts: aligning the first pivoting seat 11 with the second pivoting seat 22, and inserting the pivoting rod 32 into the two pivoting seats 11, 22 and the torsion springs 31. With the decrease of the amount of the components, the cost is reduced therefore.

With reference to FIGS. 2 and 4, with the two stops 13 abutting the outer tab 221 of the second pivoting seat 22 when the rim assembly 20 bends to a specific angle, the stops 13 limit the bending angle of the rim assembly 20.

With reference to FIGS. 1 and 2, because the ends 33 of the torsion springs 31 that abut the pivoting panel 21 are mounted adjacent to each other, the resilient force offered by the torsion springs 31 is centralized to resist the force of bending the rim assembly 20.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A basketball hoop comprising:

a stationary panel:

a first pivoting seat formed on the stationary panel and having at least one axial hole formed through the first pivoting seat;

a rim assembly connected pivotally to the stationary panel and having a rim body connected pivotally to the stationary panel; and a pivoting panel formed on the rim body and connected pivotally to the stationary panel;

a second pivoting seat formed on the pivoting panel of the rim assembly, connected pivotally to the first pivoting seat to mount the rim assembly pivotally to the stationary panel and having at least one axial hole formed through the second pivoting seat, and aligning with the at least one axial hole of the first pivoting seat; and a torsion assembly connected between the first pivoting seat and the second pivoting seat, and having at least one torsion spring mounted between the first pivoting seat and the second pivoting seat, and each one of the at least one torsion spring having two ends respectively and directly abutting the stationary panel and the pivoting panel; and a pivoting rod mounted through the at least one axial hole of the first pivoting seat, the at least one axial hole of the second pivoting seat, and the at least one torsion spring and wherein the first pivoting seat has two outer tabs formed respectively on two opposite sides of the stationary panel; a central tab formed on the stationary panel and formed between the outer tabs; and three axial holes formed respectively through the two outer tabs and the central tab; the second pivoting seat has two outer tabs formed respectively on two opposite sides of the pivoting panel; a central tab formed on the pivoting panel and formed between the outer tabs of the second pivoting seat; and three axial holes formed respectively through the outer tabs and the central tab of the second pivoting seat; and the torsion assembly has two torsion springs respectively mounted between the central tab and the outer tabs of the first pivoting seat, and respectively mounted between the central tab and the outer tabs of the second pivoting seat.

2. The basketball hoop as claimed in claim 1, wherein the ends of the torsion springs that abut the pivoting panel are mounted adjacent to each other.

3. The basketball hoop as claimed in claim 1, wherein the first pivoting seat has two steps formed respectively on the outer tabs of the first pivoting seat, and each outer tab of the second pivoting seat selectively abuts a corresponding stop of the outer tabs of the first pivoting seat.

4. The basketball hoop as claimed in claim 2, wherein the first pivoting seat has two stops formed respectively on the outer tabs of the first pivoting seat, and each outer tab of the second pivoting seat selectively abuts a corresponding stop of the outer tabs of the first pivoting seat.

* * * * *